US008272971B2

(12) United States Patent
Tutmark

(10) Patent No.: US 8,272,971 B2
(45) Date of Patent: Sep. 25, 2012

(54) GOLF BALL WITH REDUCED FLIGHT PATH LENGTH

(75) Inventor: Bradley C. Tutmark, Aloha, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 13/165,601

(22) Filed: Jun. 21, 2011

(65) Prior Publication Data

US 2011/0250983 A1 Oct. 13, 2011

Related U.S. Application Data

(63) Continuation of application No. 12/691,641, filed on Jan. 21, 2010, now abandoned.

(51) Int. Cl.
*A63B 69/36* (2006.01)
*A63B 37/00* (2006.01)

(52) U.S. Cl. ..... 473/281; 473/165

(58) Field of Classification Search ..... 473/165, 473/172, 195, 280, 281, 284, 351, 575, 576, 473/579, 580, 586; 273/317, 348, 225
See application file for complete search history.

(56) References Cited

U.S. PATENT DOCUMENTS

| | | | | |
|---|---|---|---|---|
| 1,981,959 | A | 11/1934 | Landreth | |
| 3,147,979 | A * | 9/1964 | Wolfe | 473/281 |
| 3,198,526 | A * | 8/1965 | Smith et al. | 473/281 |
| 3,940,145 | A | 2/1976 | Gentiluomo | |
| 4,836,552 | A | 6/1989 | Puckett et al. | |
| 5,209,485 | A | 5/1993 | Nesbitt et al. | |
| 5,910,057 | A * | 6/1999 | Quimby et al. | 473/353 |
| 6,270,429 | B1 * | 8/2001 | Sullivan | 473/374 |
| 6,726,577 | B1 | 4/2004 | Peterson | |
| 7,166,037 | B2 * | 1/2007 | Carter | 473/281 |
| 7,416,493 | B2 * | 8/2008 | Carter | 473/281 |
| 2004/0209701 | A1 | 10/2004 | Finkel | |
| 2006/0252569 | A1 | 11/2006 | Carter | |
| 2007/0093319 | A1 | 4/2007 | Sullivan et al. | |
| 2007/0225087 | A1 | 9/2007 | Simonutti | |
| 2009/0098951 | A1 | 4/2009 | Sullivan et al. | |

FOREIGN PATENT DOCUMENTS

| | | |
|---|---|---|
| DE | 3544766 | 6/1987 |
| EP | 0687485 | 12/1995 |

OTHER PUBLICATIONS

European Search Report in European Patent Application No. EP11151469.1, mailed on Apr. 6, 2011.

* cited by examiner

*Primary Examiner* — Nini Legesse
(74) *Attorney, Agent, or Firm* — Plumsea Law Group, LLC

(57) ABSTRACT

Golf balls with a reduced flight path are disclosed. In some cases, foam incorporated into a middle layer increases impact absorption and reduces a ball's flight path. In other cases, a dimple pattern may be selected to reduce a ball's flight path. In other instances, a parachute or other drag inducer may be deployed as a result of striking the ball to induce drag and minimize the ball's flight path.

20 Claims, 6 Drawing Sheets

GOLF BALL WITH REDUCED FLIGHT PATH LENGTH

CROSS-REFERENCE TO RELATED APPLICATIONS

This application is a continuation of U.S. application Ser. No. 12/691,641, entitled "Golf Ball With Reduced Flight Path Length", and filed on Jan. 21, 2010. This patent application is hereby incorporated by reference in its entirety.

FIELD

The present invention relates generally to golf balls used in practice. More specifically, the present invention relates to golf balls that incorporate another element that reduces the length of the flight path from a traditional flight path from a traditional ball.

BACKGROUND

Golfers, like athletes in other sports, need to practice in order to improve. Many games, such as soccer, require that an athlete have only a ball and optionally a proper pair of shoes to do some practice. Other games, such as basketball or tennis, require that a user go to another location to practice. Many of these locations are available free to the general public at parks. However, many sports require the use of space that must be rented, often at a high cost, in order to practice. Among these sports is golf.

If an athlete wishes to practice a golf shot, he or she must typically go to a driving range and pay $4-15 for a bucket of balls to hit. The athlete invests time and money also in travel to and from the driving range.

One possible alternative to this investment is to practice in the athlete's back yard. However, in most cases, practicing in one's own back yard is infeasible for golf. Striking a golf ball often propels the ball 100 yards or more, which is significantly longer than most back yards. The golf balls struck must also be retrieved, which can be time consuming or very difficult.

In the past, there have been some solutions proposed. In some instances, athletes use a ball that is a plastic shell with holes drilled there-through. These balls are effective in reducing the flight of the ball because of their weight and the increase in wind resistance. However, their appearance and weight affects the golfer's swing as well, leading to a less than desirable feel when the ball is struck.

Other solutions have involved tethering the ball. This prevents the loss of the ball, but it requires retrieval and replacement of the ball after each shot. In addition, the use of the tether affects the appearance and weight of the ball as well and therefore is less than desirable.

What would be helpful to the standard golfer is a ball that can be used in a greater variety of circumstances. It would be helpful if a ball were designed to minimize the weight and appearance changes while improving the ability to retrieve the balls and minimizing the distance traveled by any individual ball. Various designs can achieve these purposes in varying degrees and in varying combinations.

SUMMARY

In one embodiment, a golf ball includes a core and a cover at least partially surrounding the core. A cavity is defined between at least a portion of the cover and at least a portion of the core. A drag inducer is disposed in the cavity and is capable of moving from a stored position to a deployed position. A door in the cover is capable of moving from a closed position to an open position, allowing the drag inducer to move from the stored position to the deployed position.

In another embodiment, a golf ball includes a core and a cover at least partially surrounding the core. A cavity is defined between at least a portion of the core and at least a portion of the cover. A foam is disposed in the cavity. The foam is capable of absorbing impact from force applied to the ball and is capable of preventing the ball from flying more than 100 yards upon application of a standard impact of a golf club.

In another embodiment, a golf ball includes a core and a cover at least partially surrounding the core. A dampener is disposed between at least a portion of the cover and at least a portion of the core. The dampener actuates after force is applied to the ball and reduces the flight path of the ball.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

This disclosure relates to various structures that can be used by a golfer to practice a golf swing at home. Various structures can be incorporated into a golf ball to reduce the distance the golf ball will travel or fly. The embodiments disclosed demonstrate some exemplary structures.

Figure 1:
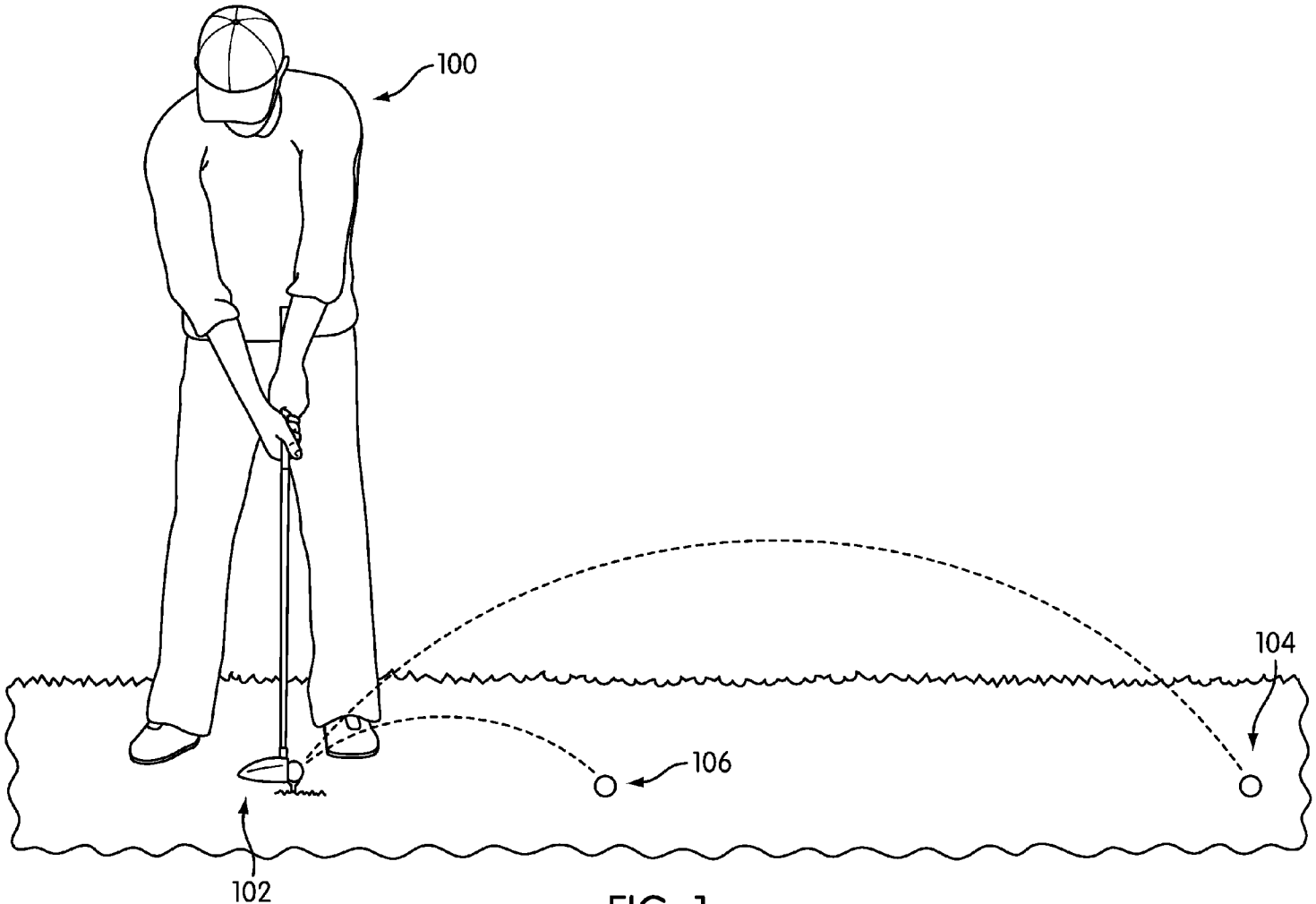
FIG. 1 is an overall view showing the flight path of a typical ball and an exemplary desirable flight path of a ball.

FIG. 1 is an overall view showing generally golfer 100 practicing a golf swing. In a typical golf swing, golfer 100 swings club 102 to contact a ball. While a driver or other wood is shown in this and other FIGS., golfer 100 may use any type of club that he or she wishes to strike the ball. In practicing a golf shot, golfer 100 may use a traditionally constructed ball, such as ball 104. However, when golfer 100 is practicing in a smaller area, such as a back yard, golfer 100 still wishes to practice, it is desirable to select ball 106 that is configured to allow golfer 100 to take a full swing and travel a reduced distance.

Figure 2:
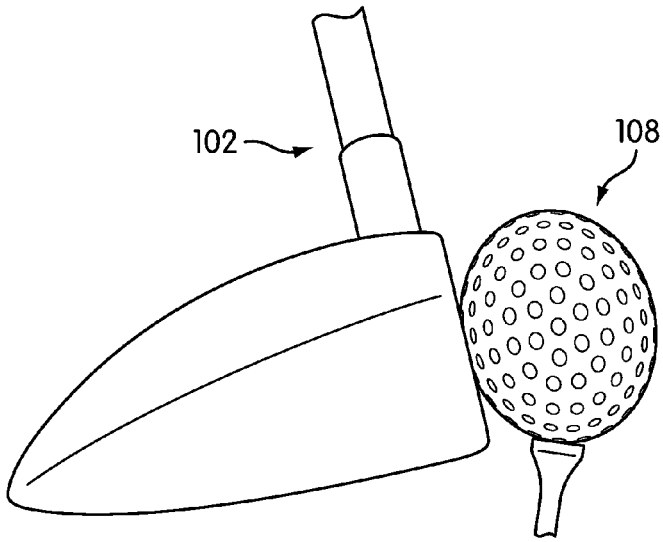
FIG. 2 is a side view of an embodiment of a ball being struck by a club when the ball has reached a degree of compression.

When golfer 100 swings club 102, club 102 contacts ball 108. Ball 108 compresses, such as shown in FIG. 2. The compression of ball 108 and its rebound to its round configuration affect the distance ball 108 travels. The material and weight of the ball affect the feel of the ball. If a ball is to be designed to have the same feel of a standard golf ball while having a shorter carry, the ball must include an element that dampens the carry, such as by dampening the rebound or flight, while the weight and cover are designed to approximate the feel of a regular ball.

Figure 3:
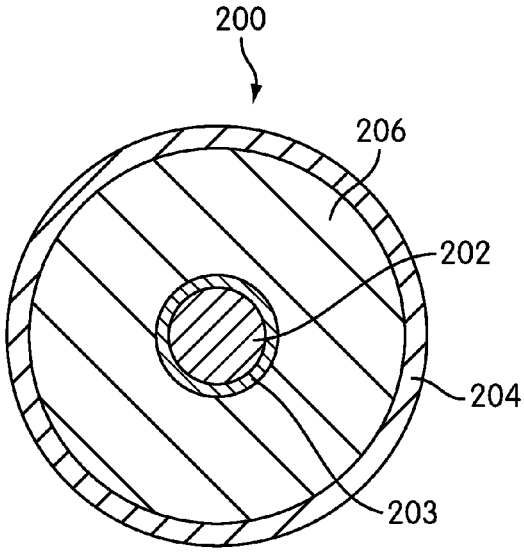
FIG. 3 is a cross-sectional view of a first embodiment of a golf ball.

A first embodiment of such a ball is seen in FIG. 3. FIG. 3 shows a ball 200. Ball 200 includes core 202 and cover 204. A cavity is formed between core 202 and cover 204 and may be filled to be middle layer 206. The application of middle layer 206 to core 202 and the further application of cover 204 to middle layer 206 is equivalent to filling a cavity between core 202 and cover 204. Middle layer 206 is radially outward of core 202. Middle layer 206 may completely cover core 202, but at least partially covers core 202. Cover 204 is radially outward of middle layer 206. Cover 204 may completely cover middle layer 206, but at least partially covers middle layer 206. Golf ball 200 may also include other layers that are not shown in this FIG., such as an optional mantle layer or a layer of printing on the outer surface of ball 200.

In some embodiments, middle layer 206 may comprise a foam. In some embodiments, the foam may be a polyurethane foam. Examples of injectable thermoplastic urethane foam include Huntsman's Smartlite® 660 and Irolite® A850. These are self-foaming thermoplastic urethane materials processable on conventional injection molding equipment. Urethane foams can also be molded using Trexel's MuCell® technology utilizing special equipment. It is also possible to use Reaction Injection Molding (RIM) to produce non-thermoplastic foam. Most golf balls sold are about at the maximum allowable weight under USGA rules for a golf ball, namely, about 1.6 ounces. It is desirable if the total weight of golf ball 200 is also about 1.6 ounces. If cover 204 is constructed to be similar to a standard ball cover, its weight is a small portion of the total desirable weight of ball 200. Typically, in order to create the dampened flight properties, the foam of middle layer 206 will be relatively light in weight. Accordingly, core 202 may be relatively heavy and dense compared to the remaining layers of ball 200. Because of the size of ball 200 and the location of core 202 in the center of ball 200, the positioning of the weight only in the center tends to mimic the feel of a standard golf ball when golfer 100 strikes golf ball 200.

However, even if golf ball 200 mimics the feel of a regular golf ball, the flight of golf ball 200 may differ from that of a regular golf ball. In use, golfer 100 will strike golf ball 200 with club 102 and will want the golf ball to travel only a comparatively short distance. Golfer 100 will typically want the ball to travel 100 yards or less. When golfer 100 strikes ball 200, the foam in middle layer 206 actuates and compresses, thereby absorbing much of the impact from the ball strike. This compression reduces the flight of ball 200 from the flight of a regular golf ball, and produces a flight path of 100 yards or less when a standard impact from a standard club is applied to ball 200. In this manner, the foam in middle layer 206 acts as a dampener, dampening the movement of ball 200 in flight.

In some instances, instead of or in addition to the use of a foam, ball 200 may include wound layer 203 that may at least partially or completely surround core 202. In an instance where wound layer 203 is used instead of a foam, the thickness of middle layer 206 can be reduced or in some instances, middle layer 206 may be eliminated. The tension applied to a cord or other material used to create wound layer 203 can be reduced from the tension typically applied to the wound layer 203. This reduction in tension alone may produce a damped rebound of ball 200 when it is struck by a golfer. In such an instance, wound layer 203 acts as a dampener to reduce the flight path of ball 200 either alone or in combination with the foam of middle layer 206.

In addition to foam or windings to dampen impact, there are thermoplastic materials that are formulated to dampen sound and impact, for instance Versaflex® Dampening Product from GLS which can change the rebound properties of a golf ball. Additionally by adding granular fillers such as, but not confined to, iron or other metal filings to a thermoplastic it may be possible to create a dampening effect. Encasing a central core which is composed of separate pieces or blacks not fused together but confined by outer layers of a golf ball can also create a dampening effect.

Figure 4:
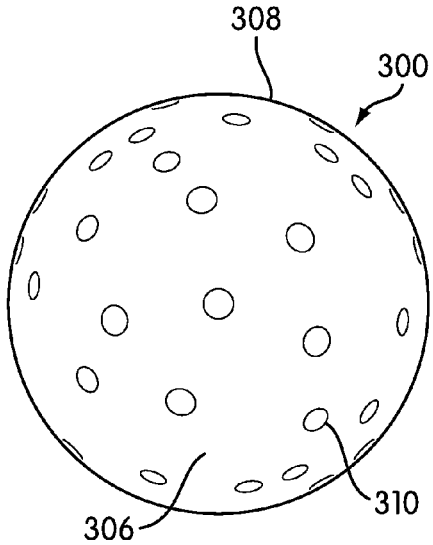
FIG. 4 is a side view of another embodiment of a golf ball.

FIG. 4 represents another alternative embodiment. FIG. 4 shows a side view of a golf ball 300. Golf ball 300 has the same general construction as a regular golf ball, and may include a core, a cover, and one or more intermediate layers. Golf ball 300 includes a cover 306 with an outer surface 308. Outer surface 308 includes a variety of dimples 310. In the embodiment shown in FIG. 4, the pattern of dimples 310 on the surface 308 is uneven or irregular. The use of a surface with an irregular pattern may be useful to minimize the flight distance of ball 300. The pattern of dimples 310 is typically designed to create the longest possible distance, but the pattern can be altered instead to minimize the flight distance instead. Because only the pattern of dimples needs to be changed, the ball can otherwise be manufactured to be identical to any other ball except for the dimple pattern applied at the end of the manufacturing process. The use of such a dimple pattern is likely to be effective to reduce the flight of ball 300 to a distance of less than 100 yards.

Figure 5:
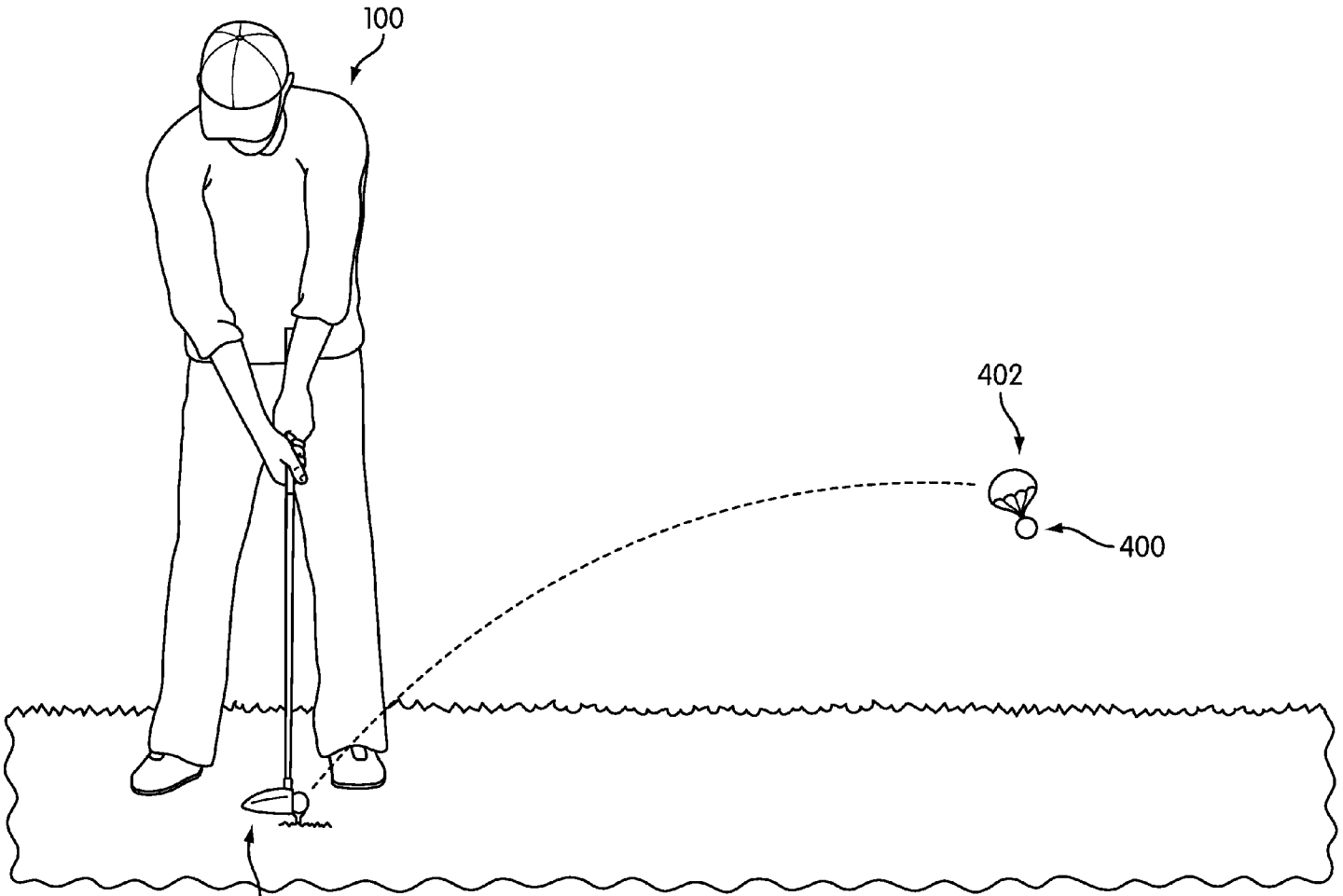
FIG. 5 is an overall view showing a golfer using one of the embodiments of FIGS. 6-9.

A different set of embodiments is shown in FIGS. 5-9. Turning first to FIG. 5, a golfer 100 uses a club 102 to strike a ball 400. After the golfer applies force to a ball 400, a drag inducer deploys. As shown in FIG. 5, the drag inducer is a parachute 402. The deploying of the parachute may be effected at different times and with different structures, as will be disclosed in more detail in connection with FIGS. 6-9.

Figure 6:
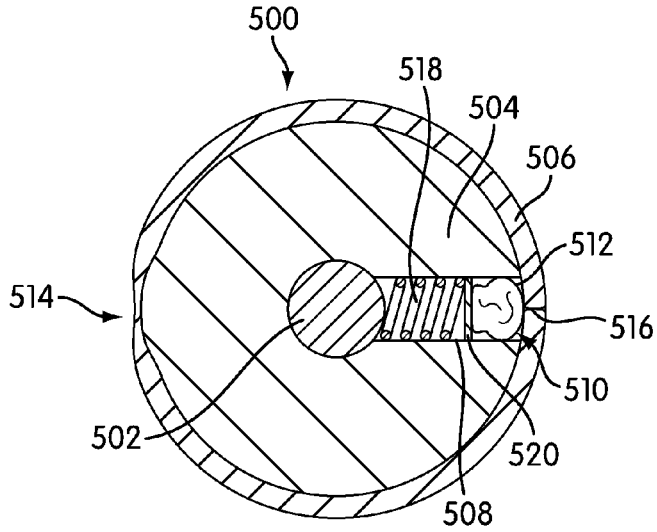
FIG. 6 is a cross-sectional view of another embodiment of a golf ball.
Figure 7:
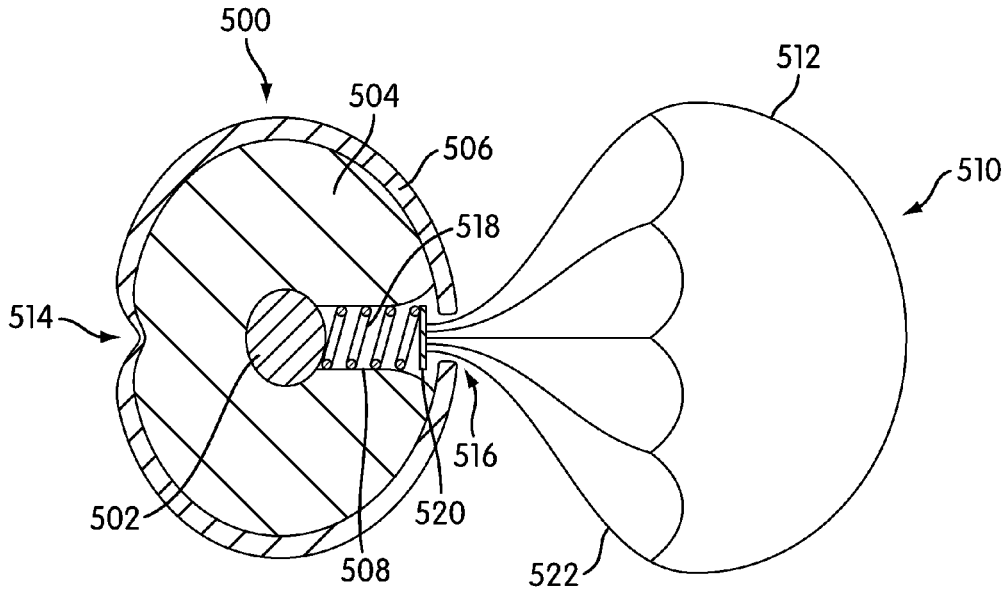
FIG. 7 is a cross-sectional view of the embodiment of FIG. 6 after the ball has been struck with a club.

A first embodiment using a parachute is shown in FIGS. 6 and 7. Ball 500 includes a core 502, a middle layer 504, and a cover 506. Middle layer 504 is positioned radially outwardly from core 502 and at least partially surrounds core 502. Cover 506 is positioned radially outwardly from middle layer 504 and at least partially surrounds middle layer 504.

A cavity 508 is defined in middle layer 504 and is positioned between at least a portion of core 502 and at least a portion of cover 506. A drag inducer or dampener 510 is disposed in cavity 508. In FIGS. 6 and 7, drag inducer or dampener 510 comprises parachute 512. Parachute 512 is shown in FIG. 6 in a stored position and is shown in FIG. 7 in a deployed position.

Ball 500 includes parts that allow parachute 512 to move from its stored position to its deployed position. Ball 500 may include weakened area 514. Weakened area 514 on ball 500 takes the form of a region where cover 506 is thinned relative to the rest of cover 506. Instead of a thinning of cover 506, weakened area 514 could be weakened in other ways, such as by increasing the porosity of cover 506 in a particular area or by using a different material in weakened area 514 from the remainder of cover 506. Any method of weakening cover 506 in weakened area 514 may be appropriate for a given application. Opposite weakened area 514 is door 516. In FIGS. 6 and 7, door 516 takes the form of a split in cover 506 adjacent cavity 508. In FIG. 6, door 516 is in a closed position, and in FIG. 7, door 516 is in an open position. Door 516 moves from its closed position to its open position when force is applied about at weakened area 514. Upon application of force, ball 500 compresses and weakened area 514 may bend inwardly. This compression in weakened area 514 may be greater than the compression in the other areas of ball 500. The compression allows the halves of split or door 516 to move apart. The moving of door 516 from its closed position to its open position exposes parachute 512.

When door 516 moves from its closed position to its open position and exposes parachute 512, a bias may be used to move parachute 512 from its stored position to its deployed position. The bias may be spring 518. Spring 518 may be positioned in cavity 508. One end of spring 518 may be secured or anchored to core 502, interior surface of cavity 508, or any other available location in ball 500. Alternatively, spring 518 may simply be placed within cavity 508. The opposite end of spring 518 may be secured or placed adjacent a first side of plate 520. When drag inducer 512 is in its stored position, spring 518 is compressed. The release of spring 518 causes the deployment of parachute 512. Plate 520 may be positioned between bias or spring 518 and drag inducer or parachute 512. First ends of strings 522 may be attached to a second side of plate 520. Alternatively, first ends of strings 522 may be secured in cavity 508 or in another part of ball 500. Second ends of strings 522 may be attached to parachute 512.

The deployment of parachute 512 may include a number of steps. First, a golfer strikes ball 500, desirably near weakened area 514. The striking of ball 500 causes the compression of ball 500, and causes an increased compression in weakened area 514. The increased compression in weakened area 514 creates a rotation of parts of cover 506 to open door 516 on the other side of ball 500. The opening of door 516 allows bias 518 to be released and press plate 520 outward towards door 516. The movement of bias 518 causes the pressing of drag inducer 512 outside of cover 506, deploying drag inducer 512. The deploying of parachute 512 creates drag on ball 500 and reduces the flight path of ball 500. In some instances, the materials, sizes, and shapes of the elements of ball 500 may be selected to minimize the flight path of ball 500 and reduce it to less than 100 yards.

Figure 8:
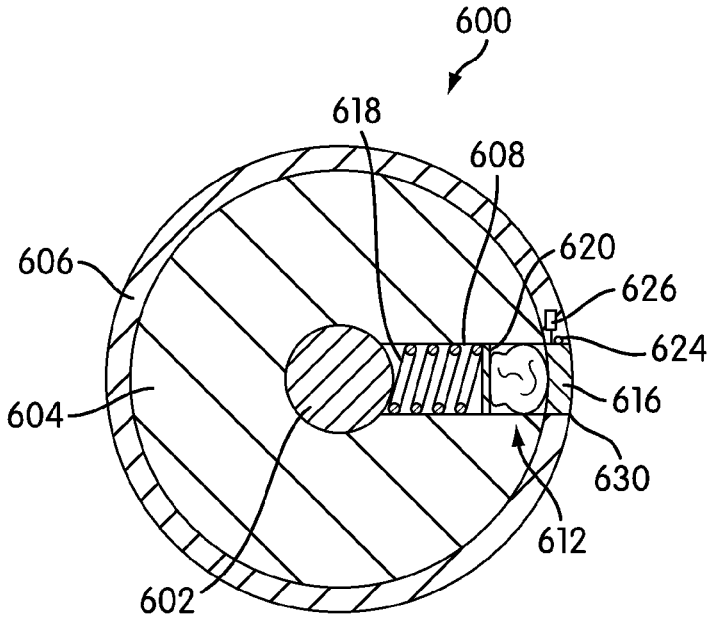
FIG. 8 is a cross-sectional view of another embodiment of a golf ball.

Another embodiment using a parachute is shown in FIG. 8. Ball 600 includes a core 602, a middle layer 604, and a cover 606. Middle layer 604 is positioned radially outwardly from core 602 and at least partially surrounds core 602. Cover 606 is positioned radially outwardly from middle layer 604 and at least partially surrounds middle layer 604.

A cavity 608 is defined in middle layer 604 and is positioned between at least a portion of core 602 and at least a portion of cover 606. A drag inducer or dampener is disposed in cavity 608. In FIG. 8, the drag inducer or dampener comprises parachute 612. Parachute 612 is shown in FIG. 8 in a stored position.

Ball 600 includes parts that allow parachute 612 to move from its stored position to its deployed position. In one area on cover 606 is door 616. In FIG. 8, door 616 is shown in its closed position. Door 616 may be rotatably secured to cover 606 in any convenient manner. In some instances, it may be desirable to secure door 616 and cover 606 together in a manner and with a structure that presents a continuous surface. FIG. 8 shows the use of a living hinge 630 as the attachment structure.

It is desirable to use a structure to further secure door 616 and cover 606 together. For example, seal 624 can be positioned along one or more sides of the opening in cover 606 to hold door 616 in place.

Door 616 may further be held in place by lock 626. Lock 626 is shown in block diagram style format in FIG. 8. Lock 626 can be placed primarily in core 602, middle layer 604, or cover 606. Lock 626 functions to hold door 616 in closed position until a designated actuation time. The actuation of lock 626 unlocks door 616 and allows door 616 to move to its open position.

A variety of structures and features can be used in connection with lock 626. In some instances, lock 626 can be electrically actuated. When a golfer strikes ball 600, the compression energy created can be used to generate an electrical signal or mechanical force that can unlock lock 626. Additional structure can be incorporated into lock 626. For example, lock 626 may include a timer. The timer can be used to delay opening of door 616 until some time after the striking of the ball. In such an instance, striking of the ball may compress the ball and trigger a piezoelectric element. The piezoelectric element may send an electrical signal to the optional timer, which counts down for a designated period, possibly as long as a second. At the end of the designated period, or at the time of the actuation of the piezoelectric element, lock 626 may be triggered to release door 616. In another alternative, lock 626 may be triggered by the mechanical force applied to ball 600 when the golfer strikes ball 600. Triggering by application of force may also include the use of a timer as mentioned earlier. Because the structures included in lock 626 can be wired in a variety of ways with a variety of elements that are well known in the industry, no detailed circuit diagram is included or necessary for understanding. The unlocking of lock 626 allows the opening of door 616.

Once door 616 is unlocked, door 616 can move from its closed position to its open position. This allows parachute 612 to move from its stored position to its deployed position. A bias may be used to move parachute 612 from its stored position to its deployed position. The bias may be spring 618. Spring 618 may be positioned in cavity 608. One end of spring 618 may be secured or anchored to core 602, interior surface of cavity 608, or any other available location in ball 600. Alternatively, spring 618 may simply be placed within cavity 608. The opposite end of spring 618 may be secured or placed adjacent a first side of plate 620. Plate 620 may thereby be positioned between bias or spring 618 and drag inducer or parachute 612. The parachute 612 may be secured to plate 620 via strings or other structures to ensure the appropriate deployment of parachute 612.

The deployment of parachute 612 may include a number of steps. First, a golfer strikes ball 600. The striking of ball 600 actuates lock 626 either directly or indirectly through mechanical or electrical means. The actuation of lock 626 releases door 616. The releasing of door 616 allows bias 618 to be released and press plate 620 outward towards door 616. The movement of bias 618 causes the pressing of drag inducer 612 outside of cover 606, deploying drag inducer 612. The deploying of parachute 612 creates drag on ball 600 and reduces the flight path of ball 600. In some instances, the materials, sizes, and shapes of the elements of ball 600 may be selected to minimize the flight path of ball 600 and reduce it to less than 100 yards.

Figure 9:
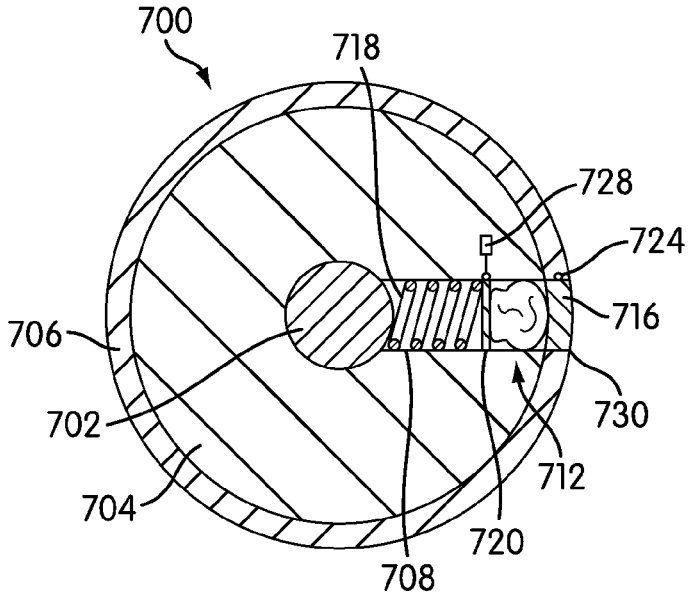
FIG. 9 is a cross-sectional view of another embodiment of a golf ball.

Another embodiment using a parachute is shown in FIG. 9. Ball 700 includes a core 702, a middle layer 704, and a cover 706. Middle layer 704 is positioned radially outwardly from core 702 and at least partially surrounds core 702. Cover 706 is positioned radially outwardly from middle layer 704 and at least partially surrounds middle layer 704.

A cavity 708 is defined in middle layer 704 and is positioned between at least a portion of core 702 and at least a portion of cover 706. A drag inducer or dampener is disposed in cavity 708. In FIG. 9, the drag inducer or dampener comprises parachute 712. Parachute 712 is shown in FIG. 9 in a stored position.

Ball 700 includes parts that allow parachute 712 to move from its stored position to its deployed position. In one area on cover 706 is door 716. In FIG. 9, door 716 is shown in its closed position. Door 716 may be rotatably secured to cover 706 in any convenient manner. In some instances, it may be desirable to secure door 716 and cover 706 together in a manner and with a structure that presents a continuous surface. FIG. 9 shows the use of a living hinge 730 as the attachment structure.

It is desirable to use a structure to further secure door 716 and cover 706 together. For example, seal 724 can be positioned along one or more sides of the opening in cover 706 to hold door 716 in place.

A bias may be used to move parachute 712 from its stored position to its deployed position. The bias may be spring 718. Spring 718 may be positioned in cavity 708. One end of spring 718 may be secured or anchored to core 702, interior surface of cavity 708, or any other available location in ball 700. Alternatively, spring 718 may simply be placed within cavity 708. The opposite end of spring 718 may be secured or placed adjacent a first side of plate 720. Plate 720 may thereby be positioned between bias or spring 718 and drag inducer or parachute 712. The parachute 712 may be secured to plate 720 via strings or other structures to ensure the appropriate deployment of parachute 712.

Bias 718 may be held in compressed position via lock 728 secured to plate 720. Lock 728 is shown in block diagram style format in FIG. 9. Lock 728 can be placed primarily in core 702, middle layer 704, or cover 706. Lock 728 functions to hold plate 720 in compressed position until a designated actuation time. The actuation of lock 728 unlocks plate 720 and allows plate 720 to move to its released position.

A variety of structures and features can be used in connection with lock 728. In some instances, lock 728 can be electrically actuated. When a golfer strikes ball 700, the compression energy created can be used to generate an electrical signal or mechanical force that can unlock lock 728. Additional structure can be incorporated into lock 728. For example, lock 728 may include a timer. The timer can be used to delay release of plate 720 until some time after the striking of the ball. In such an instance, striking of the ball may compress the ball and trigger a piezoelectric element. The piezoelectric element may send an electrical signal to the optional timer, which counts down for a designated period, possibly as long as a second. At the end of the designated period, or at the time of the actuation of the piezoelectric element, lock 728 may be triggered to release plate 720. In another alternative, lock 728 may be triggered by the force applied to ball 700 when the golfer strikes ball 700. Triggering by application of force may also include the use of a timer as mentioned earlier. Because the structures included in lock 728 can be wired in a variety of ways with a variety of elements that are well known in the industry, no detailed circuit diagram is included or necessary for understanding. The unlocking of lock 728 forces the opening of door 716.

Once lock 728 is unlocked, plate 720 is permitted to move, and bias 718 can move from its compressed position shown in FIG. 9 to its released position. This forces outward movement of plate 720. This forces parachute 712 to move from its stored position to its deployed position.

The deployment of parachute 712 may include a number of steps. First, a golfer strikes ball 700. The striking of ball 700 actuates lock 728 either directly or indirectly through mechanical or electrical means. The actuation of lock 728 releases plate 720. The releasing of plate 720 allows bias 718 to be released and press plate 720 outward towards door 716. The movement of bias 718 causes the pressing of drag inducer 712 outside of cover 706, deploying drag inducer 712. The deploying of parachute 712 creates drag on ball 700 and reduces the flight path of ball 700. In some instances, the materials, sizes, and shapes of the elements of ball 700 may be selected to minimize the flight path of ball 700 and reduce it to less than 100 yards.

Figure 10:
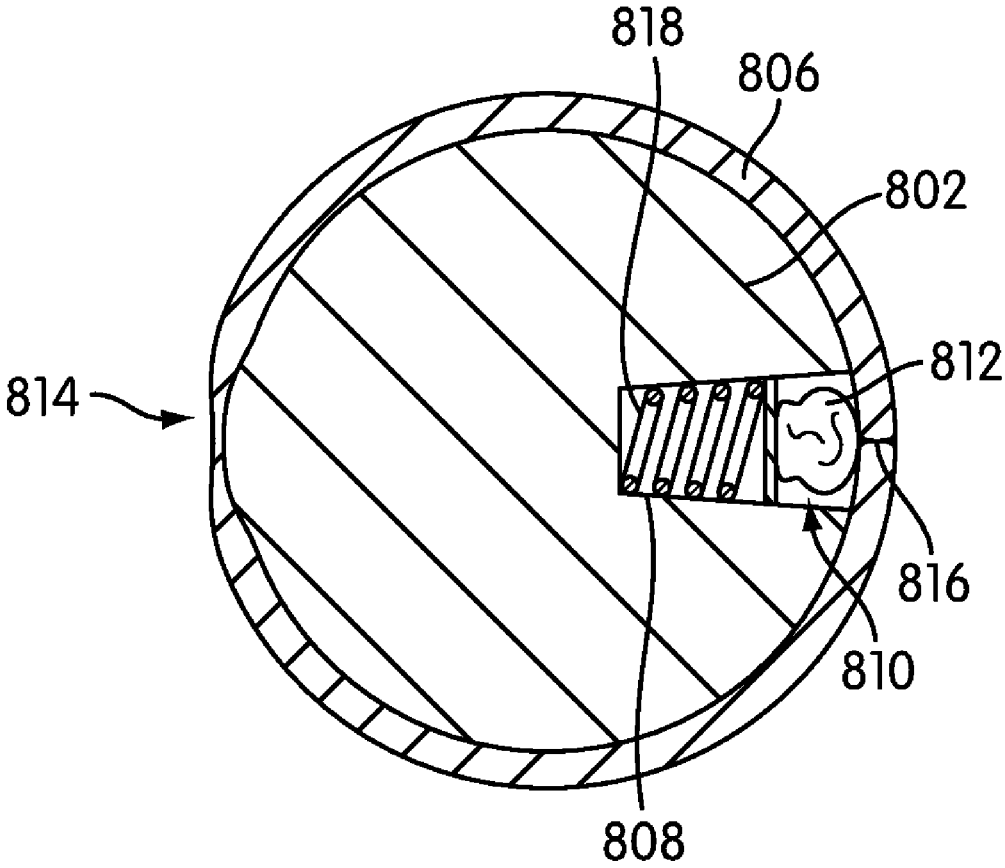
FIG. 10 is a cross-sectional view of another embodiment of a golf ball.

A further alternative embodiment is shown in FIG. 10. In the embodiment of FIG. 10, ball 800 includes two primary layers, core 802 and cover 806. Cover 806 is positioned radially outwardly from core 802 and at least partially surrounds core 802.

A cavity 808 is defined in core 802 and is positioned between at least a portion of core 802 and at least a portion of cover 806. A drag inducer or dampener 810 is disposed in cavity 808. In FIG. 10, drag inducer or dampener 810 comprises parachute 812. Parachute 812 is shown in FIG. 10 in a stored position.

The embodiment shown in FIG. 10 can be used in connection with any of the alternative embodiments shown in FIGS. 5-7. FIG. 10 shows the use of weakened area 814 similar to weakened area 514 described above and door 816 similar to door 516 described above. Upon impact, door 816 opens and drag inducer 810 deploys using bias 818 as described above. Alternatively, the use of a locking door or plate structure similar to those shown in FIGS. 8 and 9 could be used instead of a weakened area and door.

The embodiments disclosed describe the use of a core. In each instance, the core can be any of a variety of cores commonly used in golf balls. For example, the core could be liquid filled or solid filled. The solid may be rubber, resin, or any other suitable material. The core may also include various types of weights. The core may also include a wound cover. The core may also include a variety of layers. A person having ordinary skill in the art can select a core that produces the technical and flight characteristics that are desirable. While not specifically shown in the FIGS., an optional mantle layer may be included adjacent core or between any two of the other layers where desirable.

Each embodiment describes the use of a cover. In the FIGS., the cover is shown in simplified form. In a commercial version, the cover, and in particular, the outer surface of the cover, is configured to be struck by a golf club. Accordingly, the cover may include various dimples, frets or lands, projections, printing, or any other features that a designer thinks would be desirable in affecting the flight path of the ball. The cover may be designed to be scuff resistant.

The FIGS. illustrate layers having a variety of thicknesses or diameters. These thicknesses should not be considered to be the only possible thicknesses for the layers. The desirable thicknesses for the various layers depends on the materials a designer wishes to use and the protection or reactivity the designer wishes to provide by the various layers. A person having ordinary skill in the art can modify the present embodiments to provide for a ball having layers of appropriate thicknesses.

As mentioned above, it is desirable for a ball incorporating a dampening element to appear the same as a standard ball and to have the features of a standard ball. These qualities may include size, shape, weight, color, and the like. It is desirable in many of the embodiments, except where specifically excluded above, that the materials and other qualities of the ball be selected in order to create the appearance and play of the ball to be as similar to a standard ball as possible.

Various embodiments disclose and show the use of a parachute attached to a plate. The parachute may be made of any desirable material, such as paper, cloth, or the like. While the parachute is shown as being generally circular and solid, in other instances, the parachute may be square, hexagonal, or any other desirable shape. The parachute may also include vents or other cuts that provide a different drag capability. The parachute may also include multiple layers. The configuration of the parachute is not critical, but may desirable provide a drag on the ball.

Various embodiments disclose and show the use of strings attached to a parachute and a plate. Instead of strings, the parachute may have fingers that extend from the parachute main section to the plate. Other flexible fibers or solid arms can be used as an alternative to the strings and can be considered equivalent to the strings.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A golf ball, comprising:

a core; a middle layer positioned radially outward from the core and at least partially surrounds the core; a cover positioned radially outward from the middle layer and at least partially surrounding the middle layer; a cavity defined in the middle layer and disposed between at least a portion of the cover and at least a portion of the core; a door rotatably associated with the cover; and a drag inducer disposed in the cavity capable of moving from a stored position to a deployed position, wherein the drag inducer is a parachute, and wherein the golf ball remains in a single piece when the drag inducer is in both the stored position and the deployed position.

2. The golf ball according to claim 1, wherein the door is associated with the cover through a living hinge and a seal positioned along at least one side of an opening in the cover holding the door in place.

3. The golf ball according to claim 1, wherein the door is capable moving from a closed position to an open position, wherein the drag inducer is exposed upon the movement of the door from the closed position to the open position.

4. The golf ball according to claim 3, wherein the cover includes a weakened area opposite the door, and wherein the door is a slit in the cover adjacent to the cavity.

5. The golf ball according to claim 4, wherein the application of force to the weakened area causes the golf ball to compress and the weakened area to bend inwardly allowing halves of the slit to move apart to open and the drag inducer to move from the stored position to the deployed position.

6. The golf ball according to claim 3, further comprising a lock holding the door in the dosed position.

7. The golf ball according to claim 6, wherein the application of force to the ball creates an unlocking of the door.

8. The golf ball according to claim 7, wherein the unlocking of the door causes the door to open and the drag inducer to move from the stored position to the deployed position.

9. The golf ball according to claim 1, further comprising a bias that biases the drag inducer from the stored position towards the deployed position.

10. The golf ball according to claim 9, wherein the bias is in the cavity.

11. The golf ball according to claim 9, further comprising a plate between the bias and the drag inducer.

12. The golf ball according to claim 11, further comprising a lock on the plate.

13. The golf ball according to claim 12, wherein the application of force to the ball creates an unlocking of the plate.

14. The golf ball according to claims 13, wherein the unlocking of the plate causes the plate to move and the drag inducer to move from the stored position to the deployed position.

15. A golf ball, comprising:

a core;

a cover at least partially surrounding the core;

a cavity defined between at least a portion of the core and at least a portion of the cover;

a foam in the cavity, the foam having a desired level of compression, the desired level of compression being selected such that the foam is capable of absorbing impact from force applied to the ball and capable of preventing the ball from flying more than 100 yards when a standard impact is applied to the ball.

16. The golf ball according to claim 15, wherein the foam comprises polyurethane.

17. A integrally formed golf ball, comprising:

a core;

a cover at least partially surrounding the core; and a dampener disposed between at least a portion of the core and at least a portion of the cover, the dampener actuating after force is applied to the ball to reduce the flight path of the ball to a distance substantially less than a conventional ball, and wherein the ball remains integrally formed after force is applied to the ball.

18. The golf ball according to claim 17, wherein the dampener comprises a foam having a desired level of compression, the desired level of compression being selected such that the foam is capable of absorbing impact from force applied to the ball and capable of preventing the ball from flying more than 100 yards when a standard impact is applied to the ball.

19. The golf ball according to claim 17, wherein the dampener is a parachute.

20. The golf ball according to claim 17, wherein the dampener is a wound layer at least partially surrounding the core, the wound layer having a desired tension, the desired tension being selected such that the wound layer damps impact from force applied to the ball and is capable of preventing the ball from flying more than 100 yards when a standard impact is applied to the ball.

* * * * *

UNITED STATES PATENT AND TRADEMARK OFFICE

CERTIFICATE OF CORRECTION

PATENT NO. : 8,272,971 B2
APPLICATION NO. : 13/165601
DATED : October 16, 2012
INVENTOR(S) : Bradley C. Tutmark It is certified that error appears in the above-identified patent and that said Letters Patent is hereby corrected as shown below:

Col. 9 in claim 3, line 54, after “capable” insert --of--.

Col. 10 in claim 5, line 1, after “apart” delete “to open”.

Signed and Sealed this
Thirteenth Day of November, 2012

David J. Kappos

David J. Kappos
*Director of the United States Patent and Trademark Office*